US007784718B2

(12) United States Patent
Ohno

(10) Patent No.: US 7,784,718 B2
(45) Date of Patent: Aug. 31, 2010

(54) ELECTROSTATIC PAINT SPRAYER

(75) Inventor: Masahito Ohno, Yokohama (JP)

(73) Assignee: Ransburg Industrial Finishing K.K., Yokohama-shi, Kanagawa (JP)

( * ) Notice: Subject to any disclaimer, the term of this patent is extended or adjusted under 35 U.S.C. 154(b) by 58 days.

(21) Appl. No.: 11/722,108

(22) PCT Filed: Dec. 28, 2005

(86) PCT No.: PCT/JP2005/024269

§ 371 (c)(1),
(2), (4) Date: Jun. 19, 2007

(87) PCT Pub. No.: WO2006/070938

PCT Pub. Date: Jul. 6, 2006

(65) Prior Publication Data

US 2008/0006726 A1 Jan. 10, 2008

(30) Foreign Application Priority Data

Dec. 28, 2004 (JP) ..... 2004-380039

(51) Int. Cl.
*B05B 5/00* (2006.01)

(52) U.S. Cl. ..... 239/707; 239/696; 239/697; 239/700; 239/703; 239/706; 239/291; 239/296; 239/301; 239/418

(58) Field of Classification Search ..... 239/290, 239/291, 294, 296, 267, 418, 423–425, 248, 239/433, 525, 526, 690–708, 106, 112, 113, 239/300, 301, 505, 523
See application file for complete search history.

(56) References Cited

U.S. PATENT DOCUMENTS 2,004,033 A * 6/1935 Buzzard et al. ..... 239/296
2,710,773 A * 6/1955 Sedlacsik ..... 239/707
3,746,253 A * 7/1973 Walberg ..... 239/705
4,186,886 A * 2/1980 Sickles ..... 239/690.1

(Continued)

FOREIGN PATENT DOCUMENTS

| | | | |
|---|---|---|---|
| DE | 3705815 | A1 | 9/1988 |
| EP | 0767005 | A1 | 4/1997 |
| EP | 1614479 | A1 | 3/2004 |
| EP | 1418009 | A2 | 5/2004 |
| EP | 1502655 | A2 | 2/2005 |

(Continued)

OTHER PUBLICATIONS

EP Extended Search Report for EP 05824565.5 dated Oct. 7, 2008.

*Primary Examiner*—Len Tran
*Assistant Examiner*—Jason J Boeckmann
(74) *Attorney, Agent, or Firm*—Lowe Hauptman Ham & Berner LLP

(57) ABSTRACT

An electrostatic paint sprayer 10 includes a body member 12 defining a paint passage 12*a* for flowing liquid paint supplied from a paint source 44, a nozzle assembly 16 adapted to be mounted to the end of the body member 12 so as to fluidly communicate with the paint passage 12*a* and a plurality of electrode pins 22 disposed about the axis and electrically connected to a electric power source 40. The nozzle assembly includes a paint orifice for discharging the supplied paint along an axis, a plurality of atomizing air orifices for discharging atomizing air to atomize the paint dispensed through the paint orifice and a plurality of shaping orifices for discharging shaping air to form the paint dispensed through the paint orifice into a predetermined pattern.

6 Claims, 7 Drawing Sheets

U.S. PATENT DOCUMENTS

| | | | | |
|---|---|---|---|---|
| 4,245,784 | A * | 1/1981 | Garcin | 239/3 |
| 4,502,629 | A * | 3/1985 | McGhee et al. | 239/3 |
| 4,842,203 | A | 6/1989 | Kuhn et al. | |
| 5,039,019 | A * | 8/1991 | Weinstein et al. | 239/691 |
| 5,044,564 | A * | 9/1991 | Sickles | 239/690.1 |
| 5,647,543 | A * | 7/1997 | Ma | 239/706 |
| 5,775,598 | A | 7/1998 | Takayama et al. | |
| 6,708,908 | B2 * | 3/2004 | Heldt et al. | 239/700 |
| 2003/0006321 | A1 * | 1/2003 | Mather | 239/690 |
| 2004/0060510 | A1 * | 4/2004 | Ciarelli et al. | 118/308 |
| 2005/0023369 | A1 | 2/2005 | Schaupp | |
| 2007/0039546 | A1 | 2/2007 | Amari et al. | |

FOREIGN PATENT DOCUMENTS

| | | | |
|---|---|---|---|
| FR | 2354142 | A1 | 1/1978 |
| JP | 04176350 | A1 | 6/1992 |
| JP | 04200758 | A1 | 7/1992 |
| JP | 7-9446 | U | 2/1995 |
| JP | 08257441 | A1 | 10/1996 |
| JP | 09136047 | A1 | 5/1997 |

* cited by examiner

ELECTROSTATIC PAINT SPRAYER

RELATED APPLICATIONS

The present application is based on International Application No. PCT/JP2005/024269 filed Dec. 28, 2005, and claims priority from Japanese Application Number 2004-380039 filed Dec. 28, 2004, the disclosures of which are hereby incorporated by reference herein their entirety.

TECHNICAL FIELD

The present invention relates to an electrostatic paint sprayer for dispensing electrostatically charged paint to a paint object or workpiece.

BACKGROUND ART

An electrostatic paint spraying system is a system in which an earthed workpiece and a paint sprayer are provided, as positive and negative electrodes respectively, and an electric field is generated between the electrodes to efficiently attach atomized and negatively charged paint to the workpiece. Recently, in the field of electrostatic paint spraying systems, aqueous paints are increasingly used. When an aqueous paint is used in an electrostatic paint spraying system, in order to prevent the voltage charge on the paint in the paint sprayer from transmitting to a paint source through the conductive aqueous paint, a voltage block device is disposed between the paint source and the paint sprayer. Japanese Unexamined Patent Publication No. 6-198228 discloses an example of such a voltage block device.

On the other hand, another electrostatic paint sprayer, which employs an external electrode, is known. The external electrode discharges electricity to generate an ionized region in which the paint particles pass and are charged, instead of directly charging the particles, so that the particles move along the electric lines of flux (electric field) to attach to a coating object. Japanese Unexamined Patent Publication No. 7-213958 discloses an example of an indirect-charging electrostatic paint sprayer composed of a spray gun and an external electrode.

SUMMARY

In an indirect-charging electrostatic paint sprayer, an external electrode is disposed out of the paint spray region dispensed from the sprayer and a high voltage is applied thereto so as to discharge electricity toward the grounded electrode, such as a coating object, so that an electric field is generated. The paint particles passing therethrough are electrically charged so that the coating is promoted by driving the paint particles along the electric field formed toward the coating object. However, the efficiency of the electric charging of the paint particles, passing through the electric charging region, is lower compared with a direct-charging system, and thus the electric charging effect is insufficient.

Thus, the present invention is directed to solve the problem of the prior art, and to increase the electric charging efficiency of an indirect-charging electrostatic paint sprayer.

According to the present invention, there is provided an electrostatic paint sprayer, which comprises a body member defining a paint passage for flowing a liquid paint supplied from a paint source; a nozzle assembly adapted to be mounted to the end of the body member so as to fluidly communicate with the paint passage, the nozzle assembly including a paint orifice for discharging the supplied paint along an axis, a plurality of atomizing air orifices for discharging atomizing air for atomizing the paint dispensed through the paint orifice and a plurality of shaping orifices for discharging shaping air for forming the paint dispensed through the paint orifice into a predetermined pattern; and a plurality of electrode pins disposed about the axis and electrically connected to a electric power source.

BEST MODE FOR CARRYING OUT THE INVENTION

With reference to the attached drawings, the preferred embodiments of the present invention will be described below.

Figure 1:
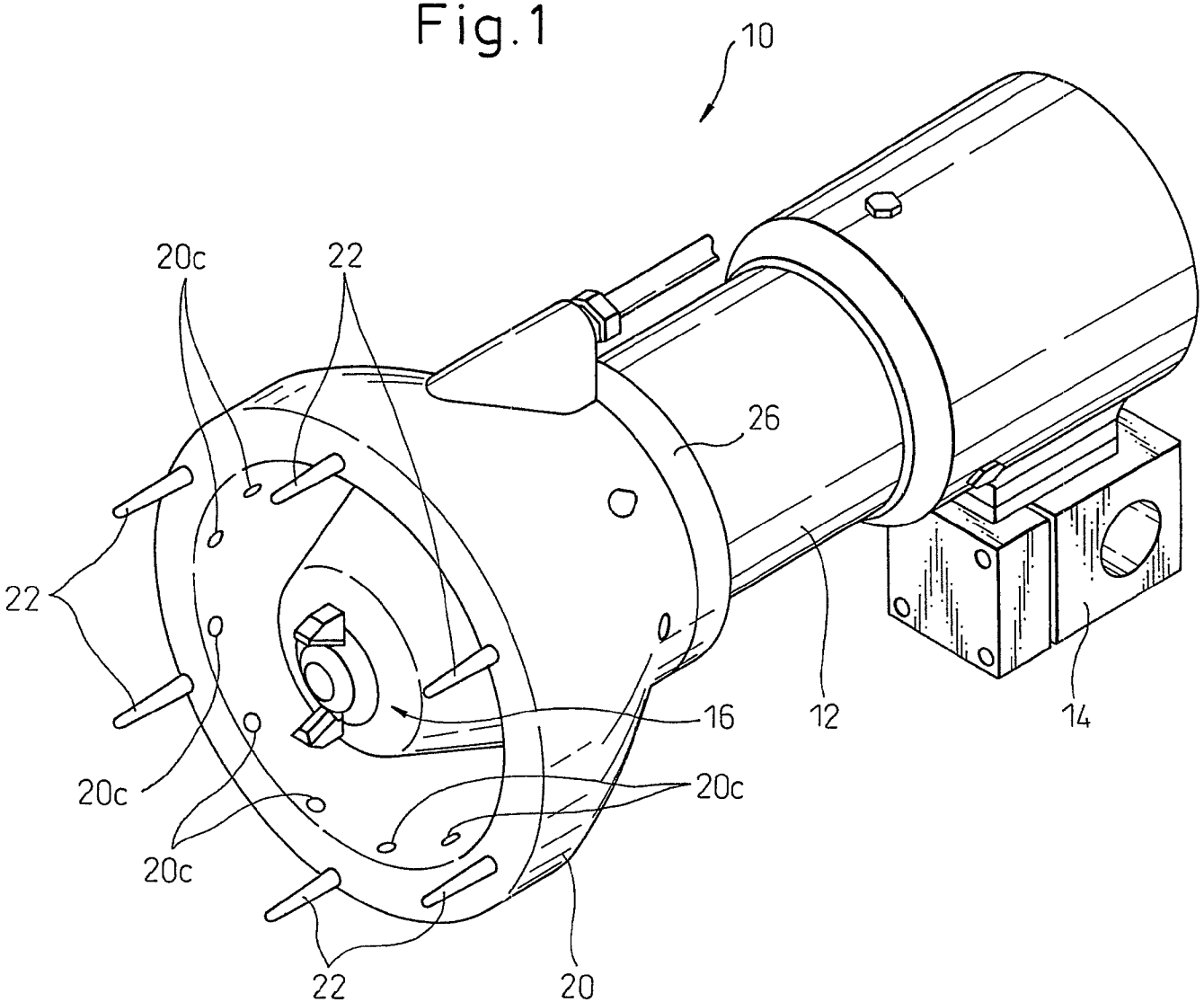
FIG. 1 is a perspective view showing the appearance of an electrostatic paint sprayer according to a first embodiment of the present invention.
Figure 2:
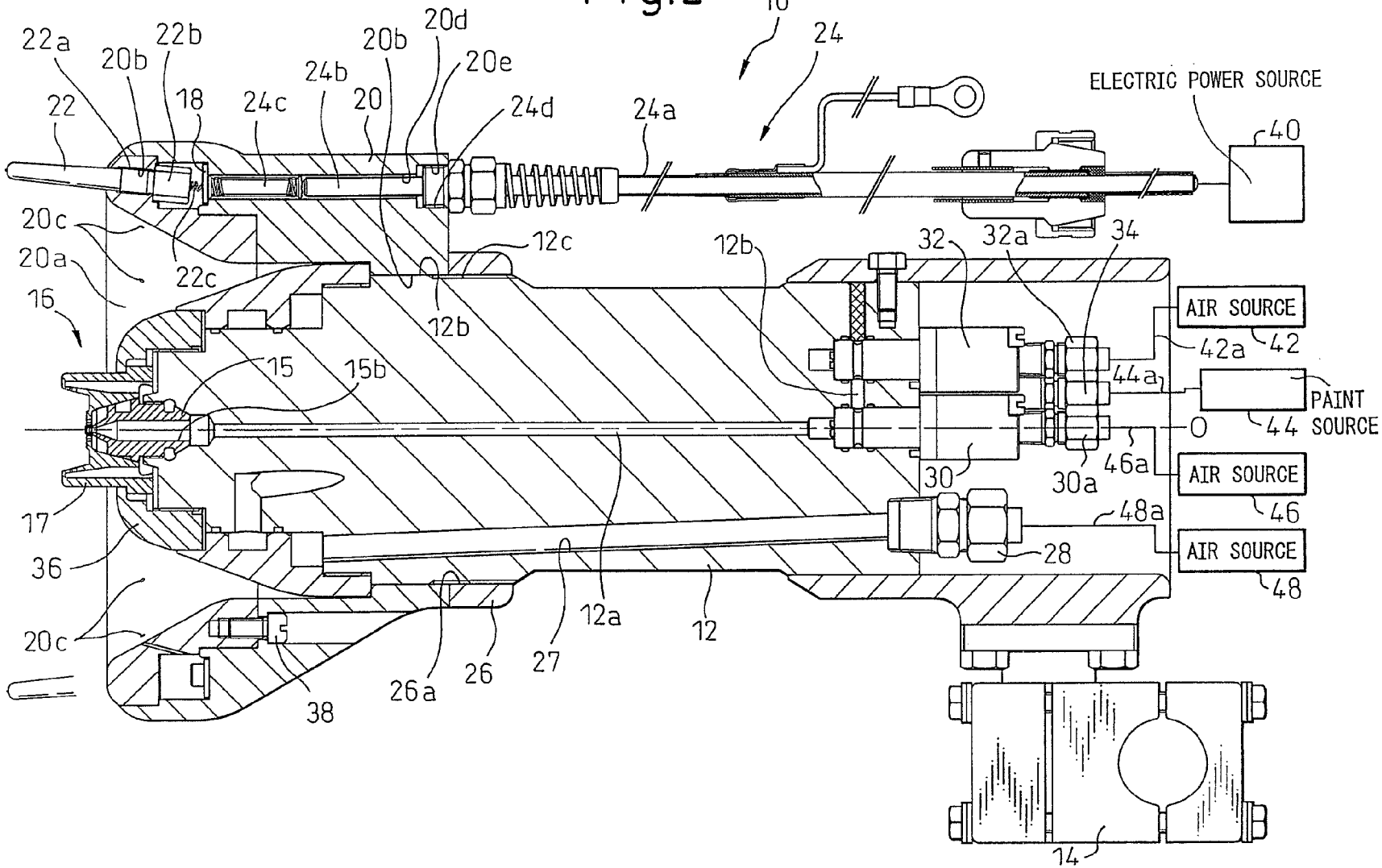
FIG. 2 is a section of the electrostatic paint sprayer of FIG. 1.
Figure 3:
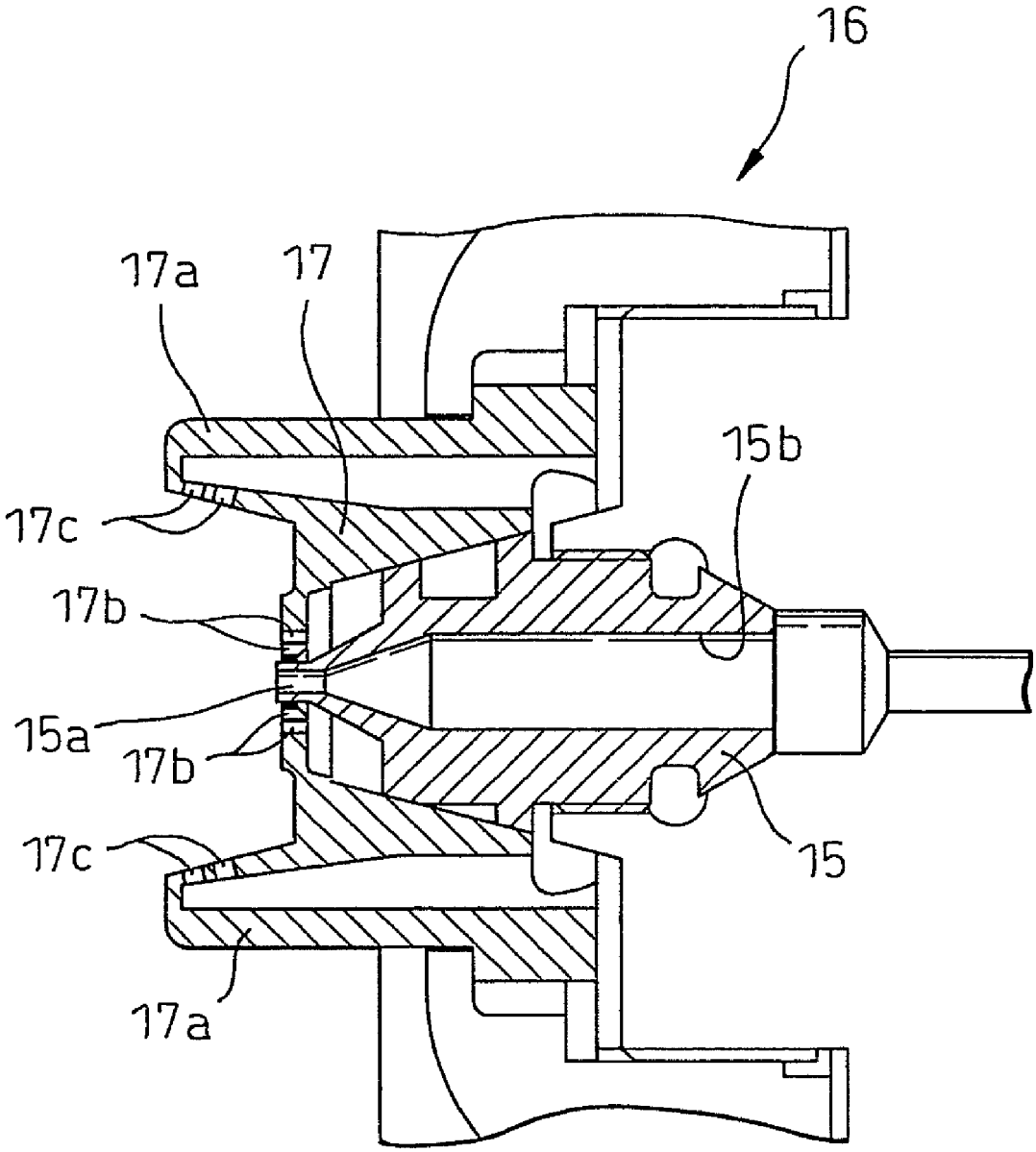
FIG. 3 is an enlarged section of a nozzle assembly of the electrostatic paint sprayer of FIG. 1.

A first embodiment of the present invention will be described with reference to FIGS. 1-3.

An electrostatic paint sprayer 10 according to the embodiment includes a cylindrical body member 12, a mount member 14 for mounting the electrostatic paint sprayer 10 to a sprayer supporting member (not shown), such as an end of a robot arm (not shown), and a nozzle assembly 16 mounted to the front end of the body member 12.

The body member 12 defines a paint passage 12*a* along an axis O. The nozzle assembly 16 is mounted to the front end of the paint passage 12*a*. A fitting 34, for connecting the paint passage 12*a* to a pain source 44, is mounted to the rear end of the paint passage 12*a*. The paint source 44 may include tanks (not shown) for containing aqueous paints, pumps (not shown), for directing the paint in the respective tanks to the paint sprayer 10, and related valve means.

Further, a pneumatically operated on-off valve 30 for opening and closing the paint passage 12*a* is provided on the paint passage 12*a*. The on-off valve 30 is fluidly connected to an air source 46 through a fitting 30*a* and a conduit 46*a* connected to the fitting 30*a*. The air source 46 for the on-off valve 30 may include, for example, a compressor (not shown), a tank (not shown), disposed at a discharge side of the compressor, for containing compressed air and a control valve (not shown) for controlling the supply of the air pressure to the on-off valve 30.

The body member 12 further defines, adjacent to the rear end, a cleaning passage 12*b* for introducing a cleaning air for the on-off valve 30. A cleaning valve 32 is provided to open and close the cleaning passage 12*b*. The cleaning valve 32 is fluidly connected to an air source 42 through a fitting 32*a* and a conduit 42*a* connected to the fitting 32*a*. The air source 42 may include, for example, a compressor (not shown), a tank (not shown), disposed at a discharge side of the compressor, for containing compressed air and a control valve (not shown) for controlling the supply of air pressure to the cleaning valve 32.

The body member 12 further defines an air passage 27 for supplying compressed air to the nozzle assembly 16. The air passage 27 is fluidly connected to an air source 48 through a fitting 28 and a conduit 48*a* connected to the fitting 28. The air source 48 for the nozzle assembly 16 may include, for example, a compressor (not shown), a tank (not shown), disposed at a discharge side of the compressor, for containing compressed air and a control valve (not shown) for controlling the air supply to the nozzle assembly 16. The air sources 42, 46 and 48 may comprise a common compressor and tank so that air can be supplied independently to the cleaning valve 32, the on-off valve 30 and air passage 27 by control valves and conduits.

The nozzle assembly 16 has a nozzle body 15 and an air cap 17. The nozzle body 15 defines a paint orifice 15*a* at the front end thereof and a passage 15*b* extending along the axis O. When the nozzle assembly 16 is mounted to the front end of the body member 12, the paint orifice 15*a* is fluidly connected to the paint source through the passage 15*b*, the paint passage 12*a* of the body member 12 and the fitting 34. The air cap 17 includes a pair of protrusions 17*a*, which are diametrically opposite to each other, a plurality of atomizing air orifices 17*b* disposed about the paint orifice 15*a* of the nozzle body 15 and shaping air orifices 17*c* disposed at the end of the protrusions 17*a*. When the nozzle assembly 16 is mounted to the front end of the body member 12, the atomizing air orifices 17*b* and the shaping air orifices 17*c* are fluidly connected to the air source 48 through the air passage 27 and the fitting 28.

The electrostatic paint sprayer 10 according to the present embodiment further includes a cup member 20, which defines an inner surface 20*a* diverging from the rear toward the front of the body member 12, an electrode ring 18 in the form of a circle about the axis O, which is electrically connected to an electric power source 40 through a cable assembly 24, and a plurality of electrode pins 22, which are disposed at a predetermined angular interval along the front end face of the cup member 20 about the axis O. The cup member 20 is mounted to the body member 12 for rotation about the axis O and fixed relative to the body member 12 by a fastener ring 26 defining an inner screw 26*a* engaging with an outer screw 12*c* defined in the outer surface of the body member 12. The cup member 20 defines a plurality of orifices 20, along the inner surface 20*a* adjacent to the front end face. Electric fluxes through the orifices 20 enhance the electric field generated around to the nozzle 16.

The electrode pins 22 are secured to the cup member 20 by inserting them into mounting holes, defined in the cup member 20 at a predetermined angular interval, and engaging the outer screws 22*a* of the electrode pins 22 with the inner screws 20*b* defined in the mounting holes of the cup member 20. The electrode pins 22 are preferably oriented so as to diverge in the forward direction by a predetermined angle, for example 5 degrees, relative to the axis O. The electrode pins 22, when secured to the cup member 20, contact at their proximal ends 22*b* the electrode ring 18 through spring 22*c* so that they are electrically connected to the electric power source 40 through the electrode ring 18 and the cable assembly 24.

The cable assembly 24 includes a power cable 24*a*, an outer screw 24*d*, providing a connection for connecting the power cable 24*a* to the cup member 20, an electrical resistance 24*b* disposed at the end of the power cable 24*a* and a coil spring 24*c*. The cable assembly 24 is secured to the cup member 20 by engaging the outer screw 24*d* with an inner screw 20*e* defined in the cable mounting hole 20*d* of the cup member 20. Thus, the electrode pins 22 are electrically connected to the electric power source 40 through the coil springs 22*c*, the electrode ring 18, the coil spring 24*c*, the electric resistance 24*b* and the power cable 24*a*.

The operation of the present embodiment will be described below.

Before spraying the paint from the electrostatic paint sprayer 10, the valves (not shown) of the air source 48 for the nozzle assembly 16 are opened to direct the compressed air from the air source 48 to the air passage 27 so that the atomizing air and the shaping air spout out of the atomizing air orifices 17*b* and the shaping air orifices 17*c* of the nozzle assembly 16, respectively. At the same time as or after the spouting of the atomizing air and the shaping air, the electric power source 40 applies a voltage to the electrode pins 22 to generate an electric field between the electrode pins 22 and a workpiece (not shown) disposed in front of the electrostatic paint sprayer 10.

Then, the air source 46 for the on-off valve 30 applies a pilot pressure to the on-off valve 30 to move the on-off valve 30 to the open position, which fluidly connects the paint passage 12*a* of the body member 12 to the paint source 44 so that the paint is dispensed toward the workpiece through the paint orifice 15*a*. This paint is atomized by the atomizing air through the atomizing air orifices 17*b*, and dispensed toward the workpiece in the form of a cone-shaped flow having a peak at the paint orifice 15*a*. The flow of the atomized paint is shaped, by the shaping air from the shaping air orifices 17*c*, into a predetermined pattern, in particular a cone having an elliptical section with its minor axis aligned with the line extending between the pair of the protrusions 17*a* of the air cap 17. The atomized paint is electrically charged during the passing through the electric field generated by the electrode pins 22.

According to the present embodiment, the plurality of electrode pins 22 form a strong and uniform electric field in front of the electrostatic paint sprayer 10 so that the paint dispensed from the electrostatic paint sprayer 10 is sufficiently charged.

FIGS. 7A-7F show the amount of the paint attaching to the front face of the electrostatic paint sprayer 10, when the paint is sprayed with the number of the electrode pins 22 altered to one, two, three, four, six and twelve, respectively. In FIGS. 7A-7F, "a" presents an area where a large amount of paint attachment is observed and thus pollution is very high, "b" shows an area of intermediate pollution and "c" shows an area of low pollution. As can be seen from FIGS. 7A-7F, disposition of at least four electrode pins 22 results in elimination of the high pollution area "a" and the intermediate pollution area "b", and thus the reduction of frequency of cleaning of the outer surface of the paint sprayer. In case of the six electrode pints 22, almost no paint attaches to the front face of the electrostatic paint sprayer 10.

Further, because the spray pattern formed by the shaping air has, as described above, an elliptical section with its minor axis aligned with the line extending between the pair of protrusions 17*a* of the air cap 17, in order to prevent the attachment of the paint to the electrode pins 22, it is advantageous to select the relative angular position of the air cap 17 and the cup member 20 so that at least one, preferably two of the plurality of electrode pins 22 are disposed on the line between the pair of protrusions 17*a*. Furthermore, the electrode pin(s) 22, which are disposed on the line extending between the pair of the protrusions 17*a*, may be longer than the others.

Figure 4:
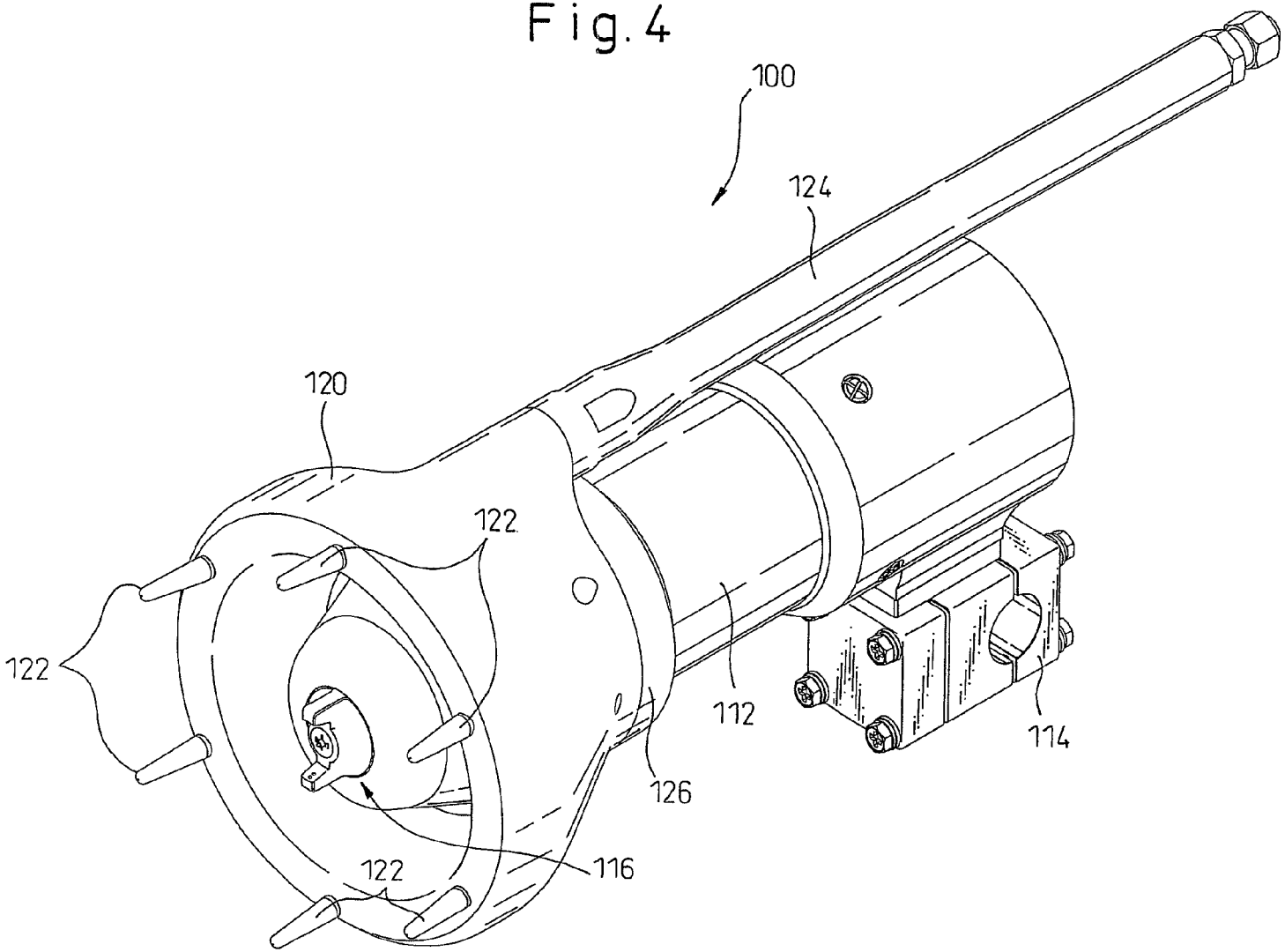
FIG. 4 a perspective view showing the appearance of an electrostatic paint sprayer according to a second embodiment of the present invention.
Figure 5:
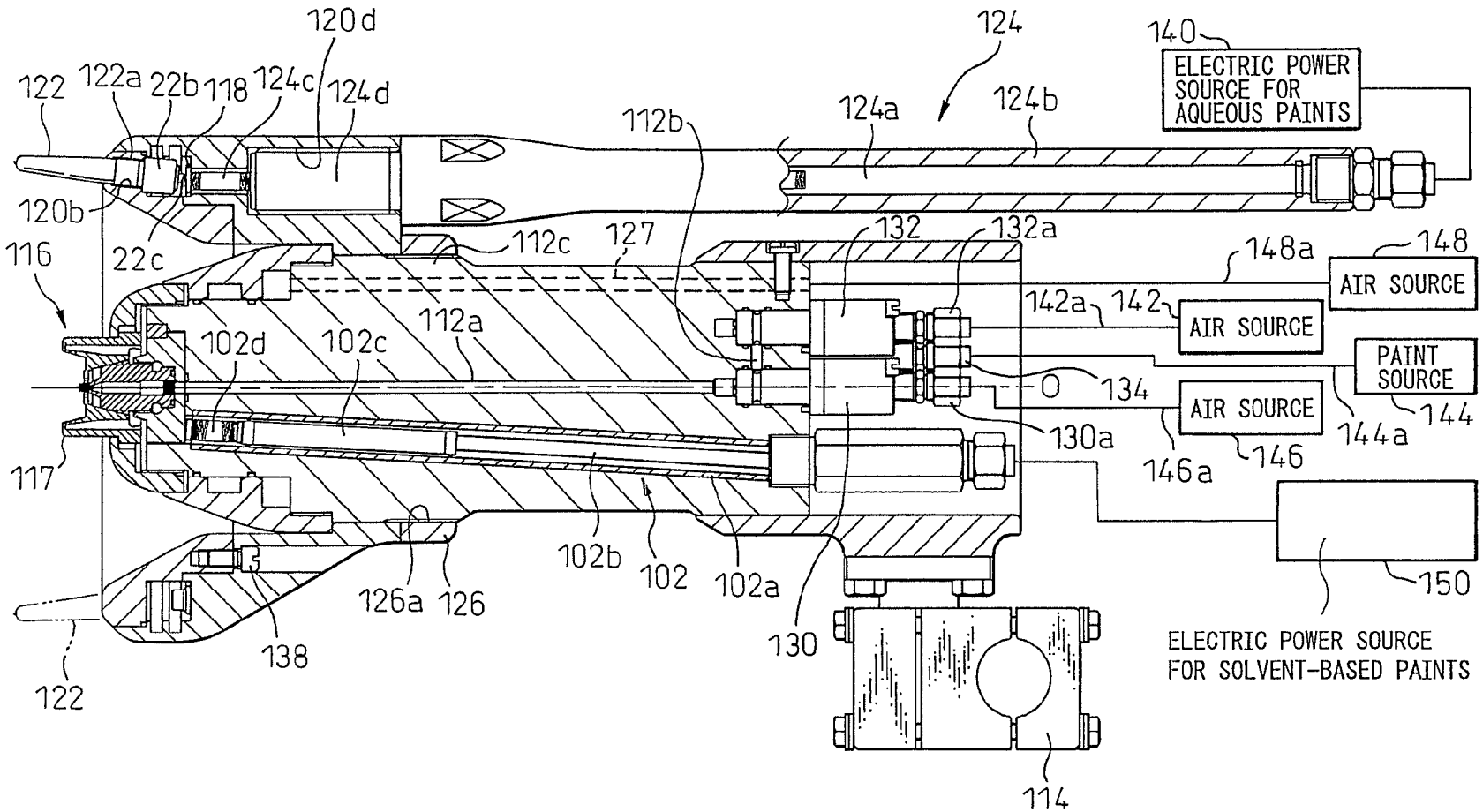
FIG. 5 is a section of the electrostatic paint sprayer of FIG. 4.
Figure 6:
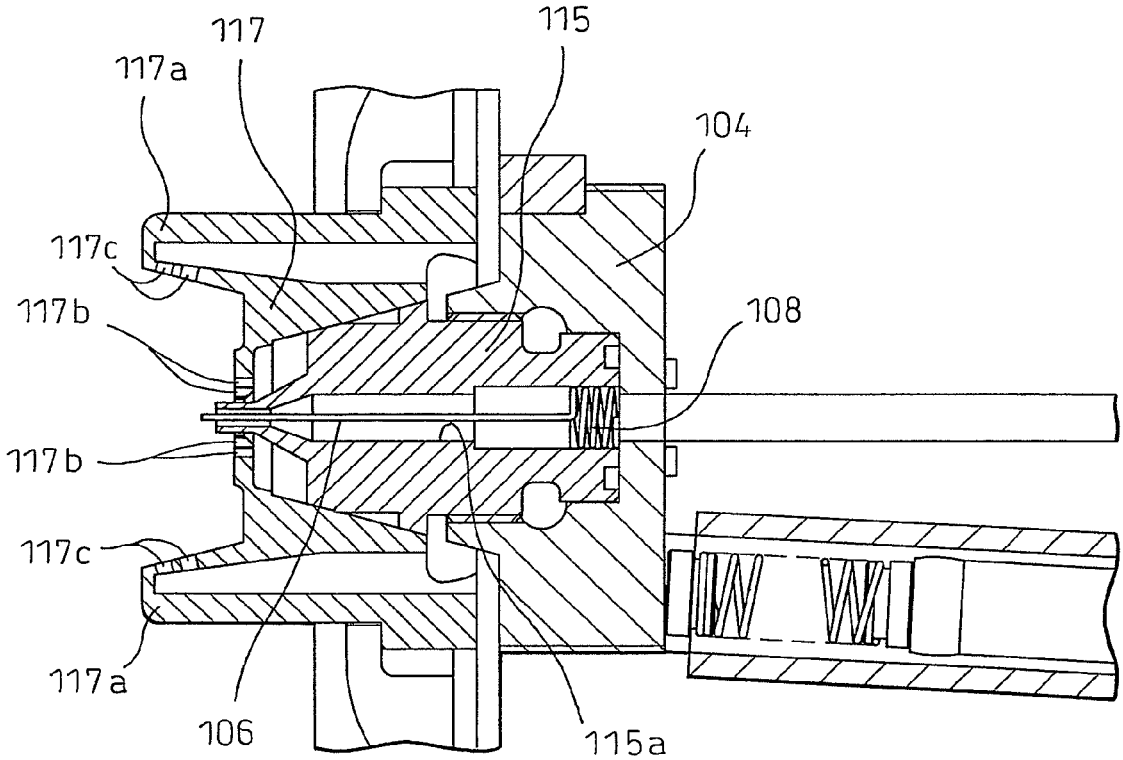
FIG. 6 is an enlarged section of a nozzle assembly of the electrostatic paint sprayer of FIG. 4.
Figure 7A:
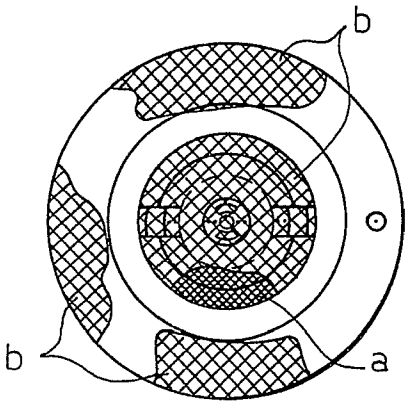
FIG. 7A is a schematic end view showing the front end portion of the electrostatic paint sprayer, and in particular the amount of the paint attaching to the front face of the electrostatic paint sprayer when the electric field is generated by a sole electrode pin.
Figure 7B:
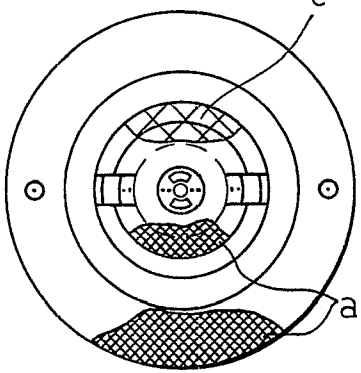
FIG. 7B is a schematic end view showing the front end portion of the electrostatic paint sprayer, and in particular the amount of the paint attaching to the front face of the electrostatic paint sprayer when the electric field is generated by two electrode pins.
Figure 7C:
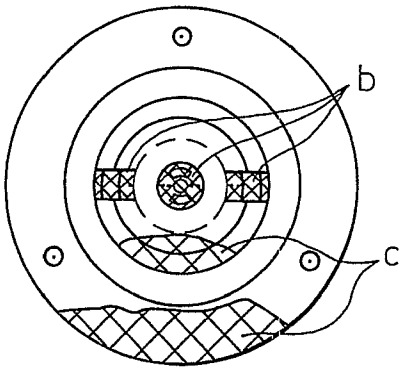
FIG. 7C is a schematic end view showing the front end portion of the electrostatic paint sprayer, and in particular the amount of the paint attaching to the front face of the electrostatic paint sprayer when the electric field is generated by three electrode pins.
Figure 7D:
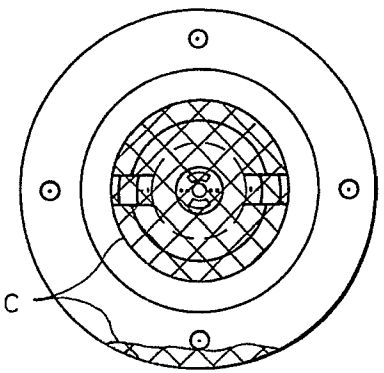
FIG. 7D is a schematic end view showing the front end portion of the electrostatic paint sprayer, and in particular the amount of the paint attaching to the front face of the electrostatic paint sprayer when the electric field is generated by four electrode pins.
Figure 7E:
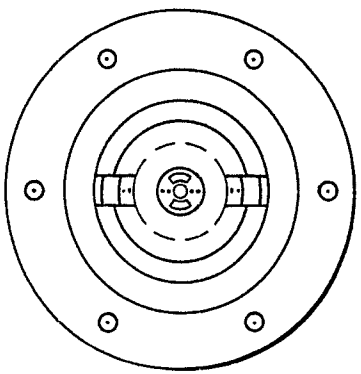
FIG. 7E is a schematic end view showing the front end portion of the electrostatic paint sprayer, and in particular the amount of the paint attaching to the front face of the electrostatic paint sprayer when the electric field is generated by six electrode pins.
Figure 7F:
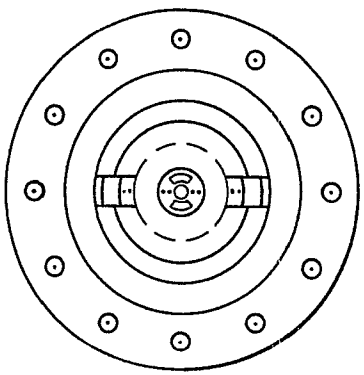
FIG. 7F is a schematic end view showing the front end portion of the electrostatic paint sprayer, and in particular the amount of the paint attaching to the front face of the electrostatic paint sprayer when the electric field is generated by twelve electrode pins.

With reference to FIGS. 4-6, a second embodiment of the present invention will be described below.

An electrostatic paint sprayer 100 according to the second embodiment of the present invention is a cylindrical body member 112, a mount member 114 for mounting the electrostatic paint sprayer 100 to a sprayer supporting member (not shown), such as an end of a robot arm (not shown), and a nozzle assembly 116 mounted to the front end of the body member 112.

The body member 112 defines a paint passage 112*a* along an axis O. The nozzle assembly 116 is mounted to the front end of the paint passage 112*a*. A fitting 134, for connecting the paint passage 112*a* to a paint source 144, is mounted to the rear end of the paint passage 112*a*. The paint source 144 may include tanks (not shown) for containing paints, pumps (not shown), for directing the paint in the respective tanks to the paint sprayer 100, and related valve means.

Further, a pneumatically operated on-off valve 130 for opening and closing the paint passage 112*a* is provided on the paint passage 112*a*. The on-off valve 130 is fluidly connected to an air source 146 through a fitting 130*a* and a conduit 146*a* connected to the fitting 130*a*. The air source 146 for the on-off valve 130 may include, for example, a compressor (not shown), a tank (not shown), disposed at a discharge side of the compressor, for containing compressed air and a control valve (not shown) for controlling the supply of air pressure to the on-off valve 130.

The body member 112 further defines, adjacent the rear end, a cleaning passage 112*b* for introducing a cleaning air for the on-off valve 130. A cleaning valve 132 is provided to open and close the cleaning passage 112*b*. The cleaning valve 132 is fluidly connected to an air source 142 through a fitting 132*a* and a conduit 142*a* connected to the fitting 132*a*. The air source 142 may include, for example, a compressor (not shown), a tank (not shown), disposed at a discharge side of the compressor, for containing compressed air and a control valve (not shown) for controlling the supply of air pressure to the cleaning valve 132.

The body member 12 further defines an air passage 127, similar to the air passage 27 of the first embodiment, for supplying compressed air to the nozzle assembly 116. The air passage 127 is fluidly connected to an air source 148 through a fitting (not shown) and a conduit 148*a* connected to the fitting. In the present embodiment, the nozzle assembly 116 further includes a metallic base member 104 and a central electrode 106 secured to the base member 104. The air source 148 for the nozzle assembly 116, similar to the air source of the first embodiment, may include, for example, a compressor (not shown), a tank (not shown), disposed at a discharge side of the compressor, for containing compressed air and a control valve (not shown) for controlling the air supply to the nozzle assembly 116. Further, the air sources 142, 146 and 148 may comprise a common compressor and tank so that the air can be supplied independently to the cleaning valve 132, on-off valve 130 and air passage 127 by control valves and conduits.

The nozzle assembly 116 has a nozzle body 115 and an air cap 117. The nozzle body 115 defines a paint orifice 115*a* at the front end thereof and a passage 115*b* extending along the axis O. When the nozzle assembly 116 is mounted to the front end of the body member 112, the paint orifice 115*a* is fluidly connected to the paint source through the passage 115*b*, the paint passage 112*a* of the body member 112 and the fitting 134. The air cap 117 includes a pair of protrusions 117*a*, which are diametrically opposite to each other, a plurality of atomizing air orifices 117*b*, disposed about the paint orifice 115*a* of the nozzle body 115, and shaping air orifices 117*c* disposed at the end of the protrusions 117*a*. When the nozzle assembly 116 is mounted to the front end of the body member 112, the atomizing air orifices 117*b* and the shaping air orifices 117*c* are fluidly connected to the air source 148 through the air passage 127 and the conduit 148*a*.

The electrostatic paint sprayer 100 according to the present embodiment further includes a cup member 120, which defines an inner surface diverging from the rear toward the front of the body member 112, an electrode ring 118 in the form of a circle about the axis O, which is electrically connected to an electric power source 140, for aqueous paints, through a first cable assembly 124, and a plurality of electrode pins 122, which are disposed at a predetermined angular interval along the front end face of the cup member 120 about the axis O. The cup member 120 is mounted to the body member 112 for rotation about the axis O and fixed relative to the body member 112 by a fastener ring 126 defining an inner screw 126*a* engaging with a outer screw 112*c* defined in the outer surface of the body member 112.

The electrode pins 122 are secured to the cup member 120 by inserting them into mounting holes, defined in the cup member 120 at a predetermined angular interval, and engaging the outer screws 122*a* of the electrode pins 122 with the inner screws 120*b* defined in the mounting holes of the cup member 120. The electrode pins 122 are also preferably oriented so as to diverge in the forward direction. The electrode pins 122, when secured to the cup member 120, contact at their proximal ends 122*b* with the electrode ring 118 through spring 122*c* so that they are electrically connected to the electric power source 140, for aqueous paints, through the electrode ring 118 and the first cable assembly 124.

The first cable assembly 124 includes a power cable 124*a*, a cable housing 124*b* for enclosing the power cable 124*a*, a connection 124*d*, which is integrally formed with the cable housing 124*b* and defines an outer screw for securing the first cable assembly 124 to the cup member 120, an electrical resistance (not shown) disposed at the end of the power cable 124*a* and a coil spring 124*c*. The first cable assembly 124 is secured to the cup member 120 by engaging the outer screw 124*d* with an inner screw defined in cable mounting hole 120*d* of the cup member 120. Thus, the electrode pins 122 are electrically connected to the electric power source 140, for aqueous paints, through the coil springs 122*c*, the electrode ring 118, the coil spring 124*c*, the electric resistance and the power cable 124*a*.

The electrostatic paint sprayer 100 according to the present embodiment further includes a second cable assembly 102, disposed in the body member 112, for applying voltage to the nozzle assembly 116. The second cable assembly 102 includes a power cable 102*b*, a housing in the form of a tubular cylinder for enclosing the power cable 102*b*, an electric resistance 102*c* provided at the end of the power cable 102*b* and a coil spring 102*d*. The coil spring 102*d* contacts the metallic base member 104 of the nozzle assembly 116, when the second cable assembly 102 is disposed in the body member 112 as shown in FIGS. 5 and 6. Thus, the central electrode 106 is electrically connected to another electric power source 150 for solvent-based paints.

The operation of the present embodiment will be described below. First, the operation, when an aqueous paint is used, will be described.

Before spraying the paint from the electrostatic paint sprayer 100, the valves (not shown) of the air source 148 for the nozzle assembly 116 are opened to direct compressed air from the air source 148 to the air passage 127 so that the atomizing air and the shaping air spout out of the atomizing air orifices 117*b* and the shaping air orifices 117*c* of the nozzle assembly 116, respectively.

At the time of or after the spouting of the atomizing air and the shaping air, the electric power source 140, for aqueous paints, applies a voltage to the electrode pins 122 to generate an electric field between the electrode pins 122 and a workpiece (not shown) disposed in front of the electrostatic paint sprayer 100. When an aqueous paint is used, the central electrode 106 is electrically isolated from the electrode pins 122 by grounding the second cable assembly 102 or by the power source 150 for solvent-based paints.

Then, the air source 146 for the on-off valve 130 applies a pilot pressure to the on-off valve 130 to move the on-off valve 130 to the open position. This fluidly connects the paint passage 112*a* to the paint source 144 so that the paint is dispensed toward the workpiece from the nozzle assembly 116. This paint is atomized by the atomizing air through the atomizing air orifices 117*b*, and shaped by the shaping air from the shaping air orifices 117*c* into a predetermined pattern, typically a cone having an elliptical section. The atomized paint is electrically indirectly charged while passing through the electric field generated by the electrode pins 122.

When a solvent-based paint is used, the atomizing air and the shaping air spout out of the atomizing air orifices 117*b* and the shaping air orifices 117*c* of the nozzle assembly 116, before the paint is dispensed from the electrostatic paint sprayer 100, as when an aqueous paint is used.

At the same time of or after the spouting of the atomizing air and the shaping air, the power source 150 for the solvent-based paint applies voltage to the central electrode 106. When a solvent-based paint is used, the electrode pins 122 are electrically isolated from the central electrode 106 by grounding the first cable assembly 124 or by the power source 140 for aqueous paints.

Then, when the on-off valve 130 moves to the open position, the paint passage 112*a* of the body member 112 is fluidly connected to the paint source so that the paint is dispensed from the nozzle assembly 116 to the workpiece, and, the central electrode 106 directly charges electricity to the paint. The charged outflowing paint is atomized by atomizing air through the atomizing air orifices 117*b*, and shaped by the shaping air from the shaping air orifices 117*c* into a predetermined pattern, typically a cone having an elliptical section.

According to the present embodiment, the plurality of electrode pins 122 form a strong and uniform electric field in front of the electrostatic paint sprayer 100 so that paint sprayed from the electrostatic paint sprayer 100 is sufficiently and indirectly charged. Further, the paint sprayer according to the present embodiment includes the central electrode 106 and the second cable assembly 102 connected to the central electrode 106, in addition to the electrode pins 122 and the first cable assembly 124 connected to the electrode pins 122, so that, in case of an aqueous paint, the paint can be indirectly charged by the electrode pins 122, and in case of a solvent-based paint, the paint is directly charge by the central electrode 106.

Further, disposition of at least four electrode pins 122, as shown in FIG. 7, results in elimination of the high pollution area, indicated by "a", and the intermediate pollution area, and thus the reduction of frequency of cleaning the outer surface of the paint sprayer. In case of the six electrode pins 122, substantially no paint attachment to the front face of the electrostatic paint sprayer 100 is resulted.

Further, because the spray pattern formed by the shaping air has, as described above, an elliptical section with its minor axis aligned with the line extending between the pair of protrusions 117*a* of the air cap 117, in order to prevent the attachment of the paint to the electrode pins 122, it is advantageous to select the relative angular position of the air cap 117 and the cup member 120 so that at least one, preferably two of the plurality of electrode pins 122 are disposed on the line between the pair of protrusions 117*a*. Furthermore, the electrode pin(s) 122, which are disposed on the line extending between the pair of the protrusions 117*a*, may be longer than the others.

The invention claimed is:

1. An electrostatic paint sprayer, comprising:

a body member defining a paint passage for flowing a liquid paint supplied from a paint source;

a nozzle assembly adapted to be mounted to the rear end of the body member so as to fluidly communicate with the paint passage, the nozzle assembly including:

a paint orifice for discharging the supplied paint along an axis, a plurality of atomizing air orifices for discharging atomizing air for atomizing the paint dispensed through the paint orifice;

an air cap having a pair of protrusions on a line centered about the paint orifice and diametrically opposite to each other;

a plurality of shaping orifices disposed on the pair of protrusions and configured to discharge shaping air for forming the paint dispensed through the paint orifice into a predetermined pattern; and a cup member mounted to the body member for rotation about the body member;

an electrode ring disposed about the axis and mounted to the cup member so as to forwardly extend from a front face of the cup member, the electrode ring electrically connected to an electric power source;

a plurality of electrode pins electrically coupled to the electrode ring and disposed about the axis, wherein at least two of the plurality of electrode pins are disposed on the line between the pair of protrusions, and wherein the electrode pins are oriented so as to diverge in a forward direction by a predetermined angle;

wherein the cup member defines a plurality of orifices along an inner surface of the cup member and adjacent to the front face of the cup member, and wherein the orifices are configured such that electric fluxes through the orifices enhance an electric field generated around the nozzle.

2. An electrostatic paint sprayer according to claim 1, further comprising a central electrode concentrically disposed with the paint orifice; and wherein the electric power source is configured to apply a voltage only to the electrode pins when an aqueous paint is used, and only to the central electrode when a solvent-based paint is used.

3. An electrostatic paint sprayer according to claim 1, wherein at least 4 electrode pins are provided.

4. An electrostatic paint sprayer according to claim 1, wherein at least 6 electrode pins are provided.

5. An electrostatic paint sprayer according to claim 1, wherein the electrode pins contact the electrode ring at their proximal ends through springs.

6. An electrostatic paint sprayer according to claim 1, wherein the body member further defines:

a pneumatically operated on-off valve configured to fluidly connect to an air source and is further configured to open and close the paint passage;

a cleaning passage adjacent to the rear end of the of the body member, configured to receive a cleaning air for the on-off valve; and a cleaning valve configured to fluidly connect to an air source and to open and close the cleaning passage.

* * * * *